US010472955B2

(12) United States Patent
Clark et al.

(10) Patent No.: US 10,472,955 B2
(45) Date of Patent: Nov. 12, 2019

(54) METHOD OF PROVIDING CONTINUOUS SURVEY DATA WHILE DRILLING

(71) Applicant: Nabors Lux 2 SARL, Luxembourg (LU)

(72) Inventors: Peter James Clark, The Woodlands, TX (US); Andrew Gorrara, Stavanger (NO); Ola Stengel, Stavanger (NO)

(73) Assignee: Nabors Lux 2 SARL, Luxembourg (LU)

( * ) Notice: Subject to any disclaimer, the term of this patent is extended or adjusted under 35 U.S.C. 154(b) by 151 days.

(21) Appl. No.: 15/852,445

(22) Filed: Dec. 22, 2017

(65) Prior Publication Data

US 2018/0119545 A1 May 3, 2018

Related U.S. Application Data

(63) Continuation-in-part of application No. 15/004,358, filed on Jan. 22, 2016, now Pat. No. 9,951,562.

(60) Provisional application No. 62/439,796, filed on Dec. 28, 2016, provisional application No. 62/108,390, filed on Jan. 27, 2015.

(51) Int. Cl.

| | |
|---|---|
| ***E21B 7/04*** | (2006.01) |
| ***E21B 47/024*** | (2006.01) |
| ***E21B 47/12*** | (2012.01) |
| ***E21B 47/09*** | (2012.01) |
| ***E21B 47/06*** | (2012.01) |
| ***E21B 47/022*** | (2012.01) |

(52) U.S. Cl.

CPC ..... *E21B 47/122* (2013.01); *E21B 47/022* (2013.01); *E21B 47/02216* (2013.01); *E21B 47/065* (2013.01); *E21B 47/09* (2013.01)

(58) Field of Classification Search

CPC ... E21B 7/04; E21B 7/06; E21B 7/062; E21B 44/005; E21B 47/09; E21B 47/024

See application file for complete search history.

(56) References Cited

U.S. PATENT DOCUMENTS

| | | | |
|---|---|---|---|
| 5,265,682 | A | 11/1993 | Russell et al. |
| 5,458,208 | A | 10/1995 | Clarke |
| 6,092,610 | A | 7/2000 | Kosmala et al. |

(Continued)

FOREIGN PATENT DOCUMENTS

| | | | |
|---|---|---|---|
| EP | 0467642 | A2 | 1/1992 |
| WO | 2014194418 | A1 | 12/2014 |

OTHER PUBLICATIONS

Search Report Issued in European Application No. 16152726.2, dated Oct. 10, 2016, 8 pages.

*Primary Examiner* — Kenneth L Thompson

(74) *Attorney, Agent, or Firm* — Enrique Abarca; Abel Schillinger, LLP

(57) ABSTRACT

A method of surveying a wellbore continuously during drilling. The method includes using a drill string with a non-rotating sub-assembly. The non-rotating sub-assembly comprises three accelerometers oriented orthogonally to each other and three directional sensors also oriented orthogonally to each other. Sample measurements from the six sensors are used to calculate the attitude of the wellbore and more specifically used to create an accurate survey of wellbores within a subterranean formation while the drill string is drilling.

19 Claims, 8 Drawing Sheets

*FIG. 2*

(56) References Cited

U.S. PATENT DOCUMENTS

| | | | | |
|---|---|---|---|---|
| 6,427,783 | B2 * | 8/2002 | Krueger | E21B 7/062 175/40 |
| 6,948,572 | B2 | 9/2005 | Hay et al. | |
| 9,951,562 | B2 * | 4/2018 | Gorrara | E21B 47/02 |
| 2003/0041661 | A1 | 3/2003 | Van Steenwyk et al. | |
| 2004/0222019 | A1 | 11/2004 | Estes et al. | |
| 2006/0263215 | A1 | 11/2006 | Sindt et al. | |
| 2009/0050370 | A1 | 2/2009 | Peters | |
| 2011/0036631 | A1 | 2/2011 | Prill et al. | |
| 2014/0262507 | A1 | 9/2014 | Marson et al. | |
| 2014/0291024 | A1 | 10/2014 | Sugiura et al. | |
| 2016/0060975 | A1 | 3/2016 | Gorrara | |
| 2017/0284158 | A1 | 10/2017 | Hongbing et al. | |

* cited by examiner

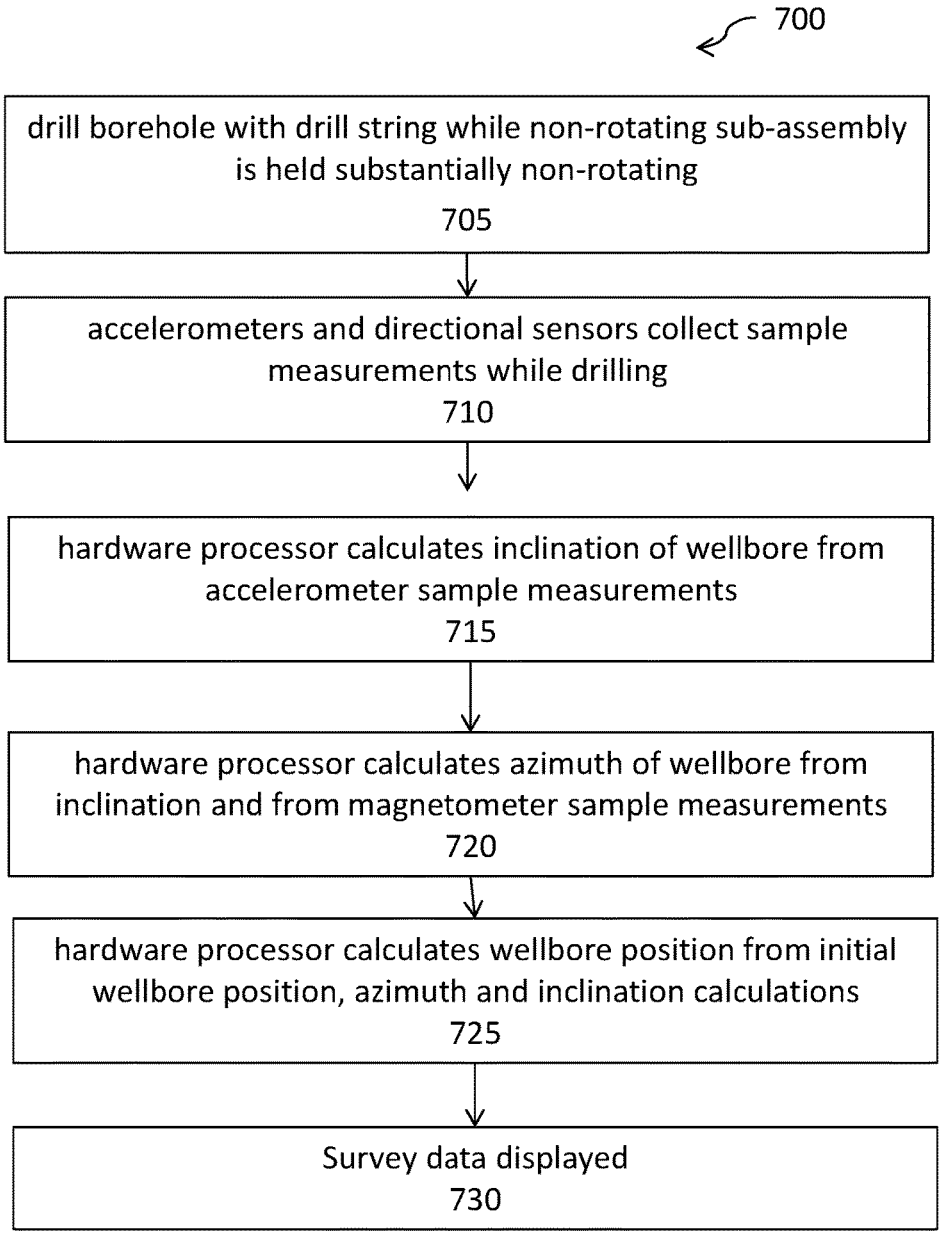
700
drill borehole with drill string while non-rotating sub-assembly is held substantially non-rotating
705
accelerometers and directional sensors collect sample measurements while drilling
710
hardware processor calculates inclination of wellbore from accelerometer sample measurements
715
hardware processor calculates azimuth of wellbore from inclination and from magnetometer sample measurements
720
hardware processor calculates wellbore position from initial wellbore position, azimuth and inclination calculations
725
Survey data displayed
730

METHOD OF PROVIDING CONTINUOUS SURVEY DATA WHILE DRILLING

RELATED APPLICATIONS

This application is a continuation-in-part to U.S. application Ser. No. 15/004,358, which is now U.S. Pat. No. 9,951,562, and claims priority to U.S. Provisional Patent Application No. 62/439,796, entitled "METHOD OF PROVIDING CONTINUOUS SURVEY DATA WHILE DRILLING," naming as inventors Peter James Clark, Andrew Gorrara, and Ola Stengel, filed on Dec. 28, 2016, and is related to U.S. patent application Ser. No. 15/004,358, entitled "METHOD AND APPARATUS FOR ORIENTING A DOWNHOLE TOOL," naming as inventor Andrew Gorrara, filed on Jan. 22, 2016, which claims priority from U.S. Provisional Patent Application No. 62/108,390, filed on Jan. 27, 2015. The entire contents of the foregoing applications are assigned to the current assignee hereof and incorporated herein by reference in their entireties.

TECHNICAL FIELD

The present disclosure relates generally to sensor assemblies for use in a wellbore and to surveying a wellbore during drilling.

BACKGROUND

Drilling subterranean wells for oil and gas is expensive and time consuming. Formations containing oil and gas are typically located thousands of feet below the earth's surface. To access the oil and gas, very long lengths of drill pipe can be required. Further, multiple wellbores can be drilled in close proximity to each other and can be directed to predetermined underground targets in a process known as "directional drilling" in which the wellbore(s) deviate from vertical at some point along their length. Accurate surveys of directional wellbores are needed to correctly locate each wellbore in order to avoid intersecting existing wells. Survey data can include the inclination (deviation from vertical) and azimuth (orientation from north) of multiple points along a wellbore.

FIG. 4 illustrates a surface and a sectional subsurface view of a wellbore 400 through the sub-surface 401 and corresponding drilling platform 402 located on the surface 403. The wellbore 400 extends below the drilling platform 402 and slants towards an orientation ending at drill location 404. Inclination is shown measured at two points, point A 405 and drill location 406. Inclination at point A 407 is the angle between the tangent of the curve of the wellbore at point A 406 and vertical 408. Inclination at the drill location 409 is also shown. Inclination is calculated through the gravity environment, usually using one or more accelerometers. Azimuth 410, the angle between the orientation of the wellbore path 411 and north 412, is often calculated using both the inclination and the magnetic or rotational environment. The combination of inclination and azimuth is referred to as attitude.

Current methods of surveying a wellbore require that drilling be stopped so that the sensors in a bottom hole assembly (BHA) of a drill string can be stationary in order to get accurate measurements. As such, survey data has been collected when drilling stops in order to add new sections of drill pipe. This operation typically occurs only once for every 90 feet of drill string length. Collecting survey data at stage in drilling can be a limitation preventing the drilling operation from resuming. If additional survey data is to be collected, the drilling must again stop, adding to the overall time required to complete a drilling operation. Accordingly, new methods are needed in the industry to provide accurate and timely survey data.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 7 is a flowchart of one example method of in accordance with an embodiment.

DETAILED DESCRIPTION OF EXAMPLE EMBODIMENTS

Figure 1:
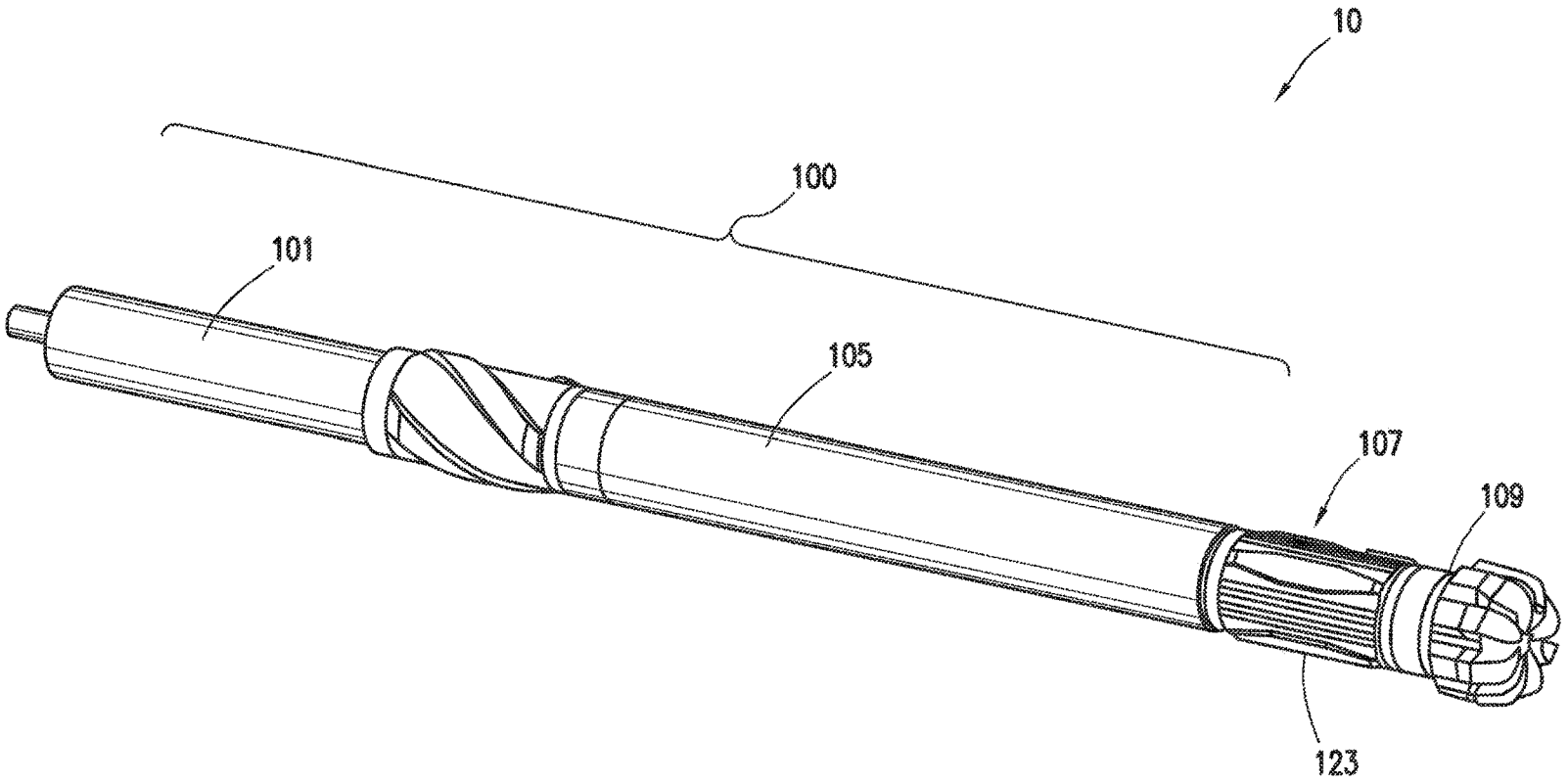
FIG. 1 depicts an elevation view of a BHA including a sensor assembly and a rotary steerable system (RSS) in accordance with an embodiment.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the drilling and fluid sensing arts. Reference to standards, including UL standards, is intended to refer to those standards in effective practice at the time of filing.

The concepts are better understood in view of the embodiments described below that illustrate and do not limit the scope of the present invention. The present disclosure relates generally to accurately surveying a wellbore continuously during drilling, and more particularly to systems, methods, and devices for providing continuous attitude measurements including inclination and azimuth, while drilling. Enabling taking accurate survey data during drilling reduces the non-productive time of a drill, allowing for reduced time to drill a well. Further, embodiments allow for accurate surveys to be performed which can help ensure accurate placement of a wellbore and allow for other wells to be drilled in close proximity.

Example embodiments will be described more fully hereinafter, in which example embodiments of systems, apparatuses, and methods for creating accurate surveys of a wellbore with continuous measurements are described. It should be understood that such systems, apparatuses, and methods may be embodied in many different forms and should not be construed as limited to the example embodiments set forth herein. Rather, these example embodiments are provided so that this disclosure will be thorough and complete, and will fully convey the scope of the claims to those of ordinary skill in the art. Like, but not necessarily the same, elements in the various figures are denoted by like reference numerals for consistency.

In some cases, the example embodiments discussed herein can be used in any type of wellbore or drilling environment, including but not limited to on-shore, off-shore, water wells, and oil and gas wells. A user may be any person that interacts with drilling a wellbore, conducting wellbore surveys, or plotting the location of potential wellbores, for example. Examples of a user may include, but are not limited to, a driller, an engineer, an instrumentation and controls technician, a mechanic, an operator, a consultant, a contractor, and a manufacturer's representative.

Terms such as "first", "second", and "within" are used merely to distinguish one component (or part of a component or state of a component) from another. Such terms are not meant to denote a preference or a particular orientation, and are not meant to limit embodiments of the disclosure. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In accordance with an embodiment, a rotary steerable system (RSS) may be included as part of a bottom hole assembly (BHA) of a drill string. The RSS may be utilized to steer the drill bit as the wellbore is formed. Because of the length of the drill string, the continuous rotation of the drill string, and difficulty in obtaining reliable sensor readings in certain downhole conditions, the ability to orient the RSS with respect to the Earth may be used to ensure that the wellbore is progressing as desired. Additionally, by looking for known formations or other downhole features, accurate orientation of the RSS may be achieved. Additionally, the RSS may facilitate continuous and accurate survey measurements to be made, calculated, obtained, transmitted, or otherwise performed as the drill-string is rotating. By removing the need for the bottom hole assembly to be held stationary in order to acquire wellbore attitude measurements, the time taken when connecting new sections of drill pipe can be reduced, reducing the overall drill time of a well.

Figure 2:
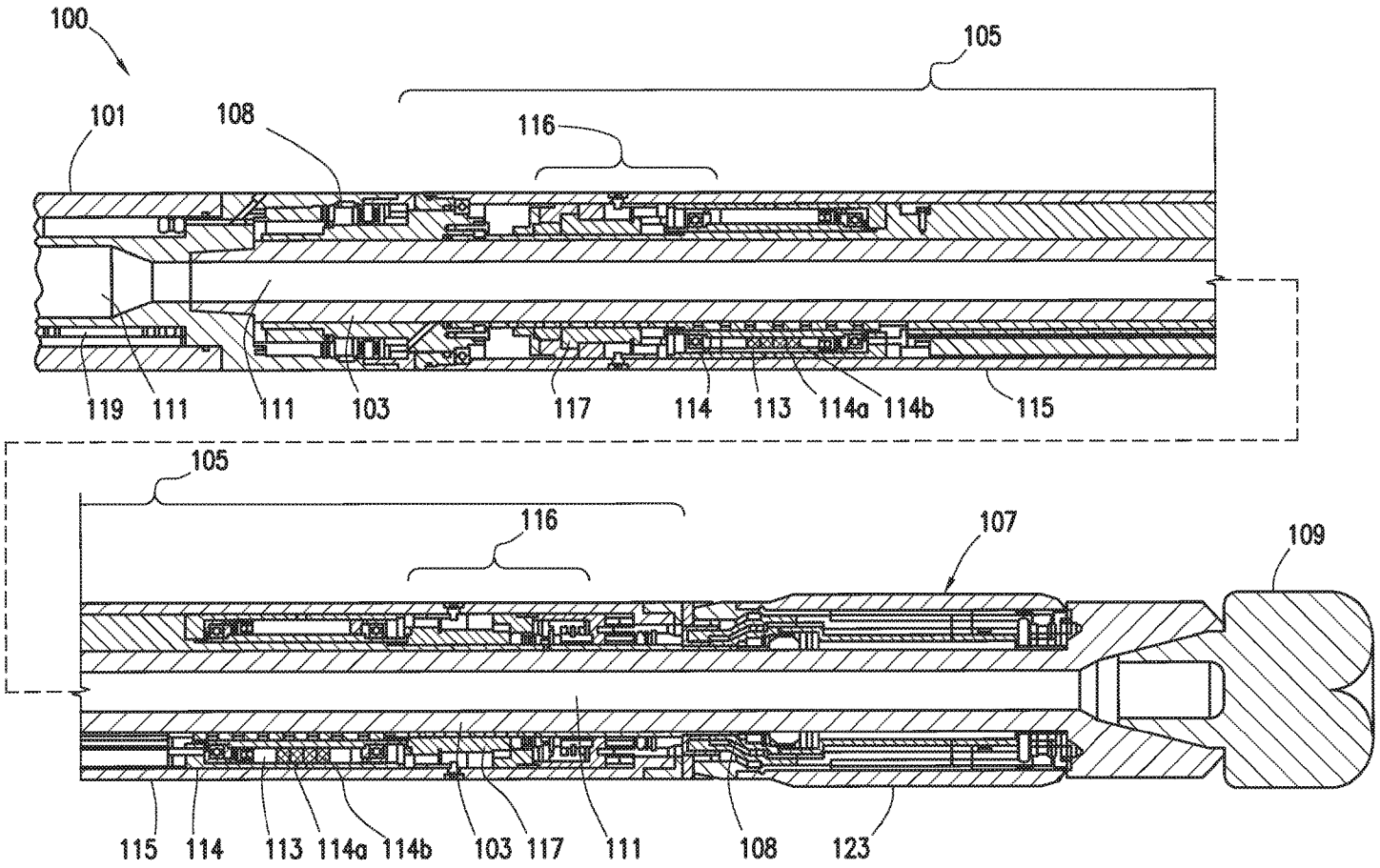
FIG. 2 depicts a partial cross section view of the BHA of FIG. 1.

FIGS. 1 and 2 illustrate an elevation view of a bottom hole assembly (BHA) 10 including a sensor assembly 100 and a rotary steerable system (RSS) 107 in accordance with an embodiment. As depicted in FIGS. 1 and 2, sensor assembly 100 may include rotating sub-assembly 101, drive shaft 103, and non-rotating sub-assembly 105. Non-rotating sub-assembly 105 may be rotatably coupled to drive shaft 103 and rotating sub-assembly 101. Non-rotating sub-assembly 105 may, as understood in the art, slowly rotate relative to the surrounding wellbore at a speed slower than drive shaft 103. The rotation of non-rotating sub-assembly 105 may be caused by friction between drive shaft 103 and non-rotating sub-assembly 105. Non-rotating sub-assembly 105 may rotate at a speed lower than 10 RPM while drive shaft 103 rotates at a higher speed. In some embodiments, sensor assembly 100 may be included as part of a drill string within a wellbore. In some embodiments, sensor assembly 100 may, as depicted in FIGS. 1 and 2, be included as part of BHA 10 coupled to the end of the drill string. In some such embodiments, BHA 10 may be configured to include RSS 107 and drill bit 109. As understood in the art, and in accordance with some embodiments, RSS 107 may be a push-the-bit system, point-the-bit system, or any other rotary steerable directional drilling system. One having ordinary skill in the art with the benefit of this disclosure will understand that sensor assembly 100 may be utilized at any location along a drill string, and need not be used with an RSS. Furthermore, one having ordinary skill in the art with the benefit of this disclosure will understand that sensor assembly 100 may be utilized with other directional drilling systems including steerable motors and other slidable steerable systems. In certain embodiments, for example, when using a magnetometer as the directional sensor, the BHA 10 can comprise non-magnetic materials. For instance, the majority of the BHA 10 can be constructed of non-magnetic materials. In an embodiment, the BHA 10 can be non-magnetic. In some embodiments, the majority of the non-rotating sub-assembly is composed of non-magnetic material. In embodiments, the non-rotating sub-assembly 105 can be non-magnetic.

In some embodiments, rotating sub-assembly 101 may be mechanically coupled to drive shaft 103, as particularly illustrated in FIG. 2. Rotating sub-assembly 101 may, in some embodiments, mechanically couple drive shaft 103 to the drill string. In some embodiments, drive shaft 103 may extend through bore 106 of non-rotating sub-assembly 105 to transfer rotational force from the rotation of the drill string to components such as drill bit 109 as depicted in FIG. 2. In some embodiments, drive shaft 103 may extend through RSS 107. In some embodiments, rotating sub-assembly 101 and drive shaft 103 may be generally tubular members which collectively form interior bore 111 through which drilling fluid may flow to drill bit 109 during drilling operations.

In some embodiments, non-rotating sub-assembly 105 may be rotatably coupled to drive shaft 103 and rotating sub-assembly 101 such that non-rotating sub-assembly 105 is capable of relative rotation thereto, but may rotate relative to the wellbore from friction therebetween, for example. In some embodiments, one or more bearings 108 may be positioned between drive shaft 103 and non-rotating sub-assembly 105 and rotating sub-assembly 101 and non-rotating sub-assembly 105 to reduce friction therebetween. In some embodiments, one or more positioning sensors 113 may be located in non-rotating sub-assembly 105. Positioning sensors 113 may include one or more gyros, accelerometers, or magnetometers. In some embodiments, one or more borehole orientation sensors 114*a* may be located in non-rotating sub-assembly 105 including one or more gyros, accelerometers, or magnetometers. In some embodiments, one or more formation sensors 114*b* may be located in non-rotating sub-assembly 105 including one or more gamma ray sensors, resistivity sensors, or sensors to measure formation porosity, formation density, or formation free fluid index. In some embodiments, non-rotating sub-assembly 105 may include outer cover 115 positioned to protect positioning sensors 113, borehole orientation sensors 114*a*, and formation sensors 114*b* from the downhole environment.

In some embodiments, the outer cover 115 of the non-rotating sub-assembly 105 may comprise components that increase the friction between the non-rotating sub-assembly 105 and the wellbore, thus, reducing or eliminating the slow or minor rotation of the non-rotating sub-sub-assembly 105 with relation to the wellbore. Such components could include fins or ribs that contact the surrounding wellbore, for example. In another embodiment, the non-rotating sub-assembly 105 could include a motor that counter rotates the non-rotating sub-assembly 105 at a speed which keeps the non-rotating sub-assembly 105 rotationally stationary with respect to the wellbore. In a further embodiment, the non-rotating sub-assembly 105 can comprise both exterior friction producing components and a counter rotating motor to correct for "slip" or "drift", that is, the relative movement between outer cover 115 and the surrounding wellbore.

In some embodiments, depending on what types of positioning sensors 113, borehole orientation sensors 114*a*, and formation sensors 114*b* are included, outer cover 115 may be at least partially formed from a non-ferromagnetic material. In some embodiments, outer cover 115 may remain in a generally fixed rotational orientation relative to the surrounding wellbore by using one or more mechanical orientation features such as fins or ribs in contact with the surrounding wellbore. However, during the course of a drilling operation, outer cover 115 may slip or drift relative to the surrounding wellbore as rotating sub-assembly 101 imparts a torque on non-rotating sub-assembly 105. Slip or drift may be further exacerbated by damage to the mechanical orientation features or wellbore conditions.

In some embodiments, borehole orientation sensors 114*a*, and formation sensors 114*b* may be coupled to sensor collar 114 positioned between drive shaft 103 and outer cover 115. Sensor collar 114 may be rotatably coupled to non-rotating sub-assembly 105. In some embodiments, non-rotating sub-assembly 105 may be coupled to sensor collar 114 through drive assembly 116 which may include motors 117. Motors 117 may rotate sensor collar 114 relative to non-rotating sub-assembly 105. By rotating sensor collar 114 at the same speed or approximately the same speed as the drift of outer cover 115 but in the opposite direction, sensors 113 in sensor collar 114 may remain generally fixed in orientation relative to the wellbore or the surrounding formation as the drill string is rotated during a drilling operation. In some embodiments, motors 117 may be electric motors, though one having ordinary skill in the art with the benefit of this disclosure will understand that any motor may be utilized, including without limitation, electric, hydraulic, or pneumatically driven motors.

In some embodiments, motors 117 may be mechanically coupled to outer cover 115. Motors 117 may rotate sensor collar 114 relative to non-rotating sub-assembly 105 by mechanical interconnection, including without limitation, one or more gears or pinions coupled to motors 117 and one or more gears or pinions coupled to one or more of non-rotating sub-assembly 105 and sensor collar 114.

In some embodiments, motors 117 may be controlled by control unit 119. FIG. 2 depicts control unit 119 positioned in rotating sub-assembly 101, although one having ordinary skill in the art with the benefit of this disclosure will understand that control unit 119 may be positioned anywhere in sensor assembly 100 without deviating from the scope of this disclosure. In some embodiments, control unit 119 may also include a processor adapted to receive sensor data from positioning sensors 113 in order to control the operation of motors 117 to position sensor collar 114 as described herein. For example, in embodiments in which positioning sensors 113 include an accelerometer, the data used may include a reading of the gravity field of the Earth. In embodiments in which positioning sensors 113 include a gyro, the data used may include a reading of the rotation of the Earth. In embodiments in which positioning sensors 113 include a magnetometer, the data used may include the magnetic field of the Earth or a known magnetic anomaly.

In some such embodiments, one or more of positioning sensors 113 may be used to maintain the orientation of sensor collar 114 relative to the wellbore and the surrounding formation. In such an embodiment, the orientation may be maintained utilizing a data point sensed by sensors 113 which corresponds to a fixed reference in the surrounding formation. In some embodiments, for example and without limitation, sensors 113 may include one or more gyros adapted to measure the Earth's rotation, accelerometers to measure gravity forces, or magnetometers to detect the Earth's magnetic field or other magnetic anomalies in the Earth. Information from sensors 113 may thus be utilized in order to drive motors 117 to maintain the orientation of non-rotating sub-assembly 105 without, in some embodiments, relying on any information regarding the rotation of rotating sub-assembly 101 or relative position sensors between non-rotating sub-assembly 105 and sensor collar 114. Thus, orientation of sensor collar 114 may be absolute relative to the wellbore or surrounding formation without relying on the relative orientation with non-rotating sub-assembly 105.

In embodiments in which control unit 119 is located in rotating sub-assembly 101, control unit 119 may be electrically coupled to sensors 113 and motors 117 located in non-rotating sub-assembly 105 by one or more wired or wireless interfaces, for example. In some embodiments, one or more slip rings or commutators may be positioned at the interface of rotating sub-assembly 101 and non-rotating sub-assembly 105 to allow continuous electrical connectivity. In some embodiments, a wireless interface such as an inductive coil may be located near the interface of rotating sub-assembly 101 and non-rotating sub-assembly 105, such as, for example, the inductive coupler described in U.S. patent application Ser. No. 14/837,824, filed Aug. 27, 2015, the entirety of which is hereby incorporated by reference. In some embodiments in which control unit 119 is located in non-rotating sub-assembly 105, such a wired or wireless interface may be utilized to transmit power from a power source located in rotating sub-assembly 101 to control unit 119.

Additionally, in order to transmit power to or transmit or receive data from sensors 113 located in sensor collar 114, a wired or wireless interface may be utilized. For example, one or more slip rings or commutators may be used for power or data transmission. For embodiments utilizing a wireless interface, information and/or power may in some embodiments be transmitted through one or more inductive coils located at or near the interface between rotating sub-assembly 101 and non-rotating sub-assembly 105. In some embodiments, information may be transmitted through one or more radio frequency or electromagnetic communication links. One having ordinary skill in the art with the benefit of this disclosure will understand that any combination of wired or wireless links may be used without deviating from the scope of this disclosure.

In some embodiments, control unit 119 may further include data storage mechanisms adapted to store sensor data for later retrieval. In some embodiments, control unit 119 may include transmission mechanisms adapted to transmit data to the surface. In some embodiments, control unit 119, motors 117, and sensors 113 may be powered by a battery, wired power supply, a generator, or a combination thereof, included with or coupled to sensor assembly 100.

As an example, in some embodiments, as understood in the art, RSS 107 may include RSS outer housing 123, which remains generally oriented with the wellbore during a directional drilling operation. Typically, RSS outer housing 123 remains in position by using one or more mechanical orientation features such as fins or ribs in contact with the surrounding wellbore. However, slippage or damage to these orientation features may cause the toolface of RSS 107 to drift or become otherwise unknown during a drilling operation. Toolface, as understood in the art and used herein, is reference direction of RSS 107 corresponding to a known direction relative to a reference coordinate system. In some embodiments, RSS outer housing 123 may be coupled to or formed as a part of non-rotating sub-assembly 105. By utilizing the known orientation of sensor collar 114 as a reference for RSS 107, the toolface of RSS 107 may be maintained relative to the surrounding formation. Thus, the path of the wellbore drilled thereby may be accurately guided.

Additionally, in some embodiments, by rotating sensor collar 114 relative to the wellbore irrespective of the rotation of non-rotating sub-assembly 105, one or more of borehole orientation sensors 114*a* and formation sensors 114*b* may be rotationally aimed within the wellbore. In such an embodiment, borehole orientation sensors 114*a* or formation sensors 114*b*, such as a magnetometer or gamma ray sensor may be accurately repositioned within the wellbore in order to survey the surrounding formation. Because the orientation of sensor collar 114 relative to the surrounding formation is known and the rotation of sensor collar 114 may be precisely controlled by motors 117, the orientation, direction of rotation, and rate of rotation of borehole orientation sensors 114*a* or formation sensors 114*b* at each sensor reading may be known accurately. In some embodiments, formation properties measured by rotating borehole orientation sensors 114*a* or formation sensors 114*b* may be compiled to generate a 3D representation of the formation around the wellbore. Additionally, by accurately determining properties of the surrounding formation, for example and without limitation, the wellbore may be drilled to remain within or close to a desired formation layer.

Figure 3A:
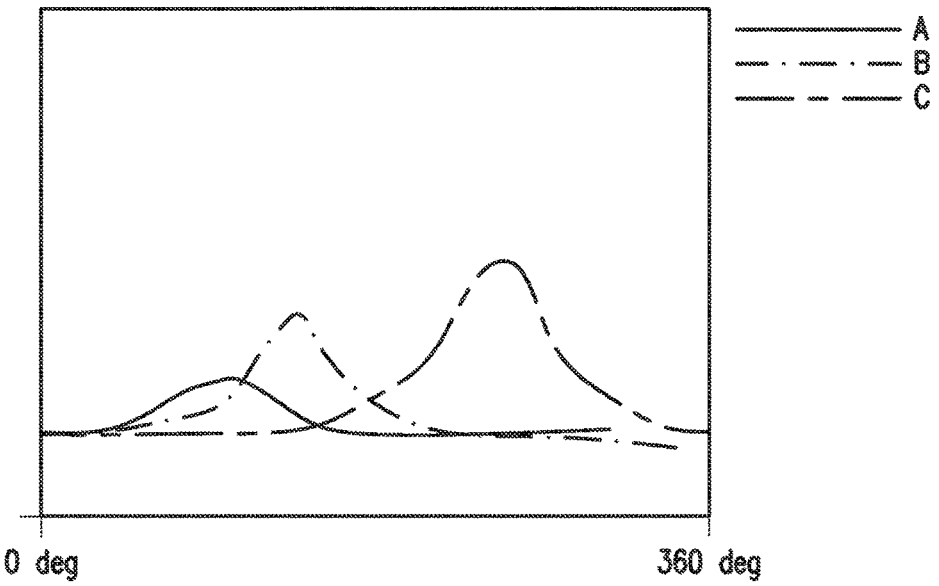
FIG. 3*a* depicts an example of the readings of a sensor assembly for three magnetic anomalies as shown in FIG. 3*b*, in accordance with an embodiment.
Figure 3B:
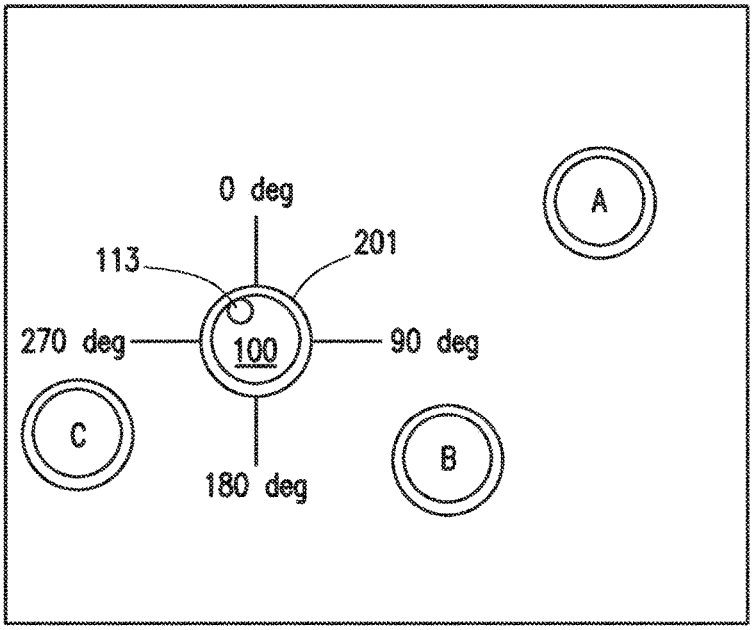
Figure 4:
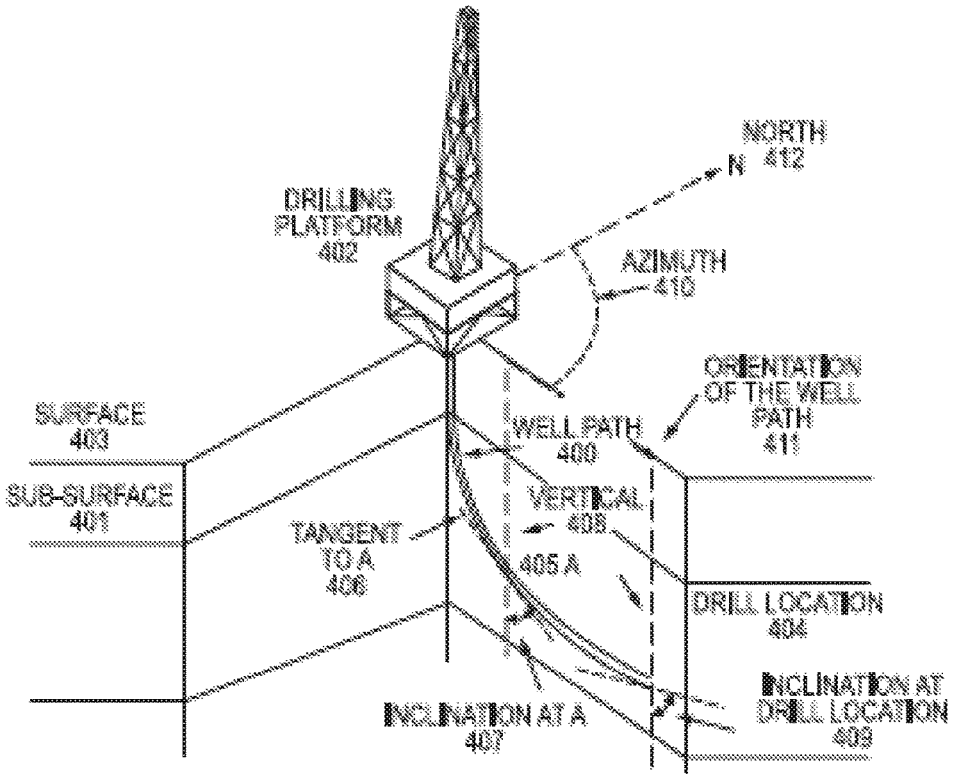
FIG. 4 illustrates how inclination and azimuth are calculated from a well path.

Additionally, downhole formation features or other objects may be accurately located relative to the wellbore. As an example, FIGS. 3*a*, 3*b* depict a measurement operation to locate a metal tubular in the formation surrounding wellbore 201 in which sensor assembly 100 is positioned. FIG. 3*b* depicts three possible locations A, B, C, for a tubular positioned near wellbore 201. By interpreting magnetometer data, the location of the tubular may be determined by, for example and without limitation, finding the offset angle of the sensor at which the maximum magnetic anomaly is detected. FIG. 3*a* depicts a graph of magnetometer data against offset angle for each possible location. The offset angle may be determined by control unit 119. By knowing the location of the tubular, the desired drilling operation may continue. For example, collision with the detected tubular may be avoided in a crowded reservoir. Alternatively, the wellbore may be drilled a desired distance from the detected tubular or remain parallel thereto as in an enhanced recovery operation such as a steam-assisted gravity drainage operation. As another example, in a well intervention, the detected tubular may be targeted to be intercepted by the wellbore being drilled.

In some embodiments, control unit 119 may include a computer readable memory module which may include pre-programmed instructions for controlling sensor collar 114. In some embodiments, control unit 119 may include a receiver for receiving instructions. In some embodiments, control unit 119 may include a transmitter for transmitting information or control signals to other downhole equipment, including, for example, RSS 107. The communication medium for the receiver and/or transmitter may include, for example and without limitation, a wired connection, mud pulse communication, electromagnetic transmission, or any other communication protocol known in the art. In some embodiments, the instructions may include, for example and without limitation, rotate sensor collar 114 to locate a maximum magnetic reading and identify the direction to the maximum magnetic reading using the offset angle of the sensor. In some embodiments, the instructions may include rotate sensor collar 114 to locate a geological anomaly such as, for example and without limitation, a natural gamma ray reading and identify the direction to the geological anomaly using the offset angle of the sensor. In some embodiments, the instruction may further include transmitting a command to RSS 107 to steer toward or away from the identified direction.

In some embodiments, the instructions may include rotating sensor collar 114 while collecting data from one or more of borehole orientation sensors 114*a* or formation sensors 114*b* to generate a model of the wellbore and surrounding formation. In some embodiments, such data may be collected as sensor assembly 100 is moved through the wellbore. In such an embodiment, the model of the wellbore may be three dimensional.

Although described herein as utilizing only a single sensor collar 114, one having ordinary skill in the art with the benefit of this disclosure will understand that multiple sensor collars 114, each having their own sensors 113 may be included in non-rotating sub-assembly 105 without deviating from the scope of this disclosure. Additionally, one having ordinary skill in the art with the benefit of this disclosure will understand that each sensor collar 114 may be driven independently by separate motors 117.

In accordance with an embodiment, surveying a wellbore during drilling can include the use of six sensors. In an embodiment, the six sensors can include three accelerometers and three directional sensors. In accordance with an embodiment, the three accelerometer can each be orthogonally located with respect to each other. Similarly, the three directional sensors can each be orthogonally located with respect to each other. In an embodiment the three accelerometers and three directional sensors can be arranged such that the axis of each accelerometer can be orthogonal to the other accelerometers and the axis of each directional sensor can be orthogonal to the other directional sensors. A directional sensor can include a magnetometer, a gyroscope, or a combination thereof.

Figure 5:
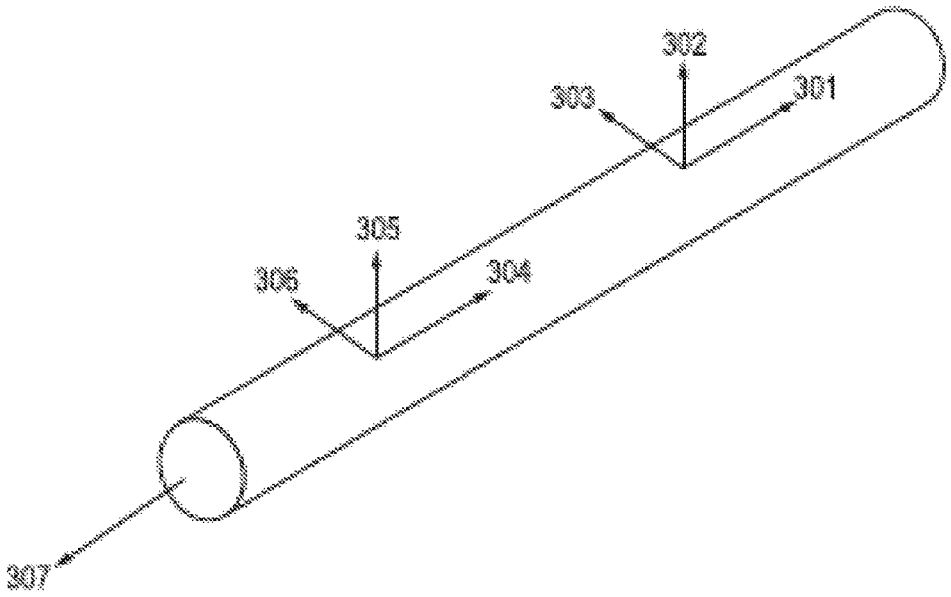
FIG. 5 illustrates the orientation of three accelerometers axes, three directional sensor axes, and the drill axis, in accordance with an embodiment.

FIG. 5 demonstrates an embodiment of a non-rotating sub-assembly 105 where the first accelerometer 301 axis can be aligned with the directional axis of the drill string (and wellbore), while the second 302 and third 303 accelerometer axes can be arranged orthogonally across the directional axis of the drill string. In the same way, the first directional sensor 304 can be arranged with its axis aligned with the directional axis of the drill string (and wellbore), while the second 305 and third 306 directional sensor axes can be arranged orthogonally across the directional axis of the drill string. Since the first directional sensor 304 and the first accelerometer 301 can be moving at a constant velocity and not accelerating during drilling, the motion of the drill in the direction of their axes may not affect the readings of the sensors 301 and 304.

In some embodiments of the disclosure, the first accelerometer 301 and first directional sensor 304 do not need to be aligned with the axis of the drill string, as the measurements from a non-drill string aligned configuration can be mathematically transformed into an aligned configuration (i.e. by calibration or correction). Similarly, the first, second, and third directional sensors do not need to be substantially orthogonal to each other. "Substantially orthogonal," as used herein, refers to sensors that are within 10 degrees of orthogonal. In some embodiments, the first, second, and third directional sensors (304, 305, and 306) are within 30 degrees, 20 degrees, 10 degrees, 5 degrees or 2 degrees of orthogonal to each other. Prior to collecting sample measurements, the directional sensors can be calibrated to correct for the lack of orthogonality to each other. In some embodiments, the first, second, and third accelerometers (301, 302, and 303) are within 30 degrees, 20 degrees, 10 degrees, 5 degrees or 2 degrees of orthogonal to each other. Prior to collecting sample measurements, the accelerometers can be calibrated to correct for the lack of orthogonality.

In an embodiment in which the directional sensor is a magnetometer, additional embodiments of the disclosure include the addition of a fourth, fifth and/or sixth magnetometer, with their axis aligned with the axis of the first, second and third magnetometers. The addition of multiple sensors can improve the estimates of Z-axis interference and enable real-time magnetic ranging.

In accordance with an embodiment, the direction sensors (304, 305, and 306) can be magnetometers. In accordance with another embodiment, the directional sensors (304, 305, and 306) can be gyroscopes. Any known accelerometer may be used as the first, second, and third accelerometers (301, 302, and 303). Examples of accelerometers that can be used are piezoelectric accelerometers, and Micro Electro-Mechanical System (MEMS) accelerometers. Examples of magnetometers that can be used are flux gate magnetometers. Example of gyroscopes that can be used are MEMS gyroscopes.

Figure 6:
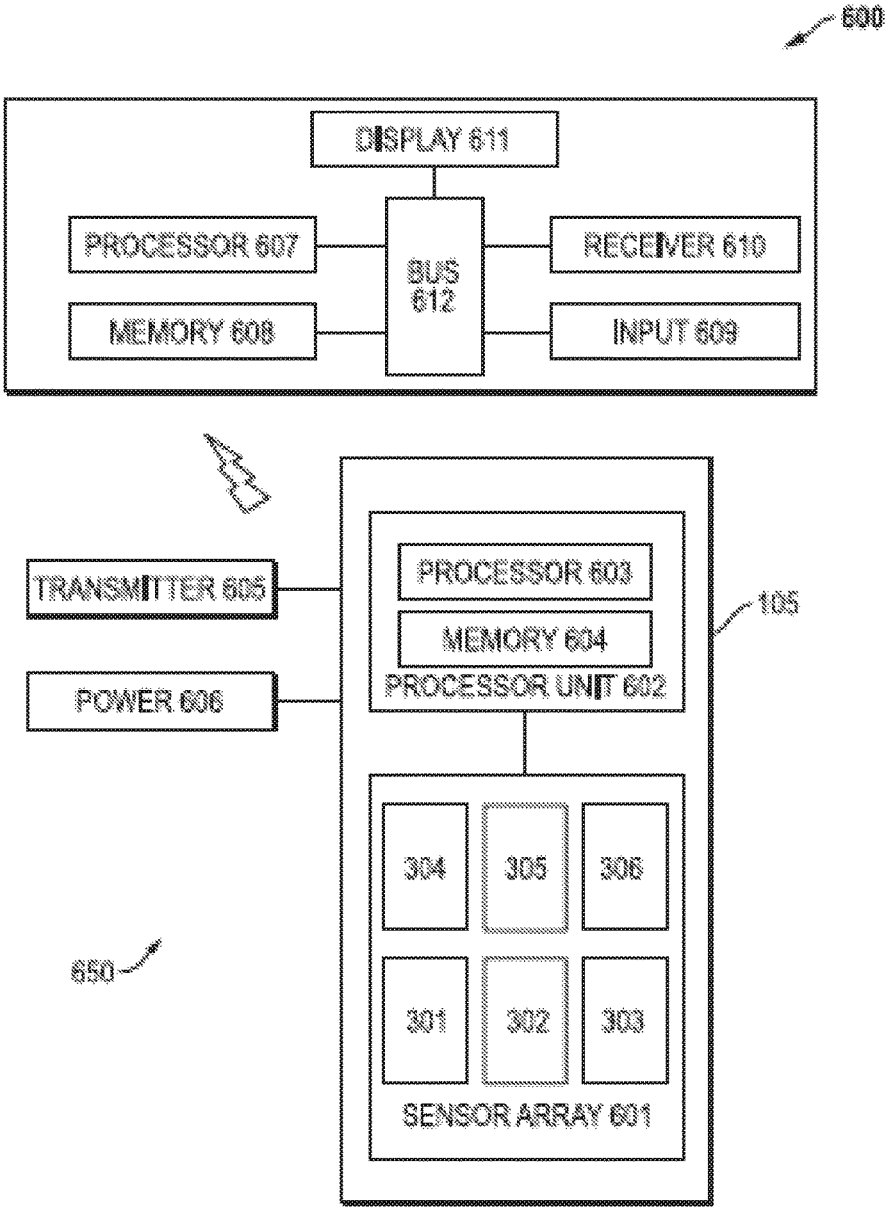
FIG. 6 illustrates an embodiment of components of the non-rotating subassembly and components located at the surface.

FIG. 6 illustrates a system diagram of an example system 650 used to produce accurate survey data continuously while drilling. The system 650 can include a non-rotating sub-assembly 105, that can be part of a bottom hole assembly (BHA) 10 of a drill string, and a surface computing device 600. The non-rotating sub-assembly 105 can comprise a sensor array 601, which can include three accelerometers (301, 302, and 303) and three directional sensors (304, 305, 306). The sensor array 601 can be coupled to a sub-assembly processor unit 602. The sub-assembly processor unit 602 can include a processor 603 and a memory/storage 604. The sub-assembly processor unit 602 and/or the sensor array 601 can be coupled to a transmitter 605 and a power source 606. The surface computing device 600 can be located at the surface 403, and can be located at or near the drilling platform 402 or may be located at a remote location. The sensor array may also include a temperature sensor (not shown).

The processor 603 of the sub-assembly processor unit 602 can be a hardware processor and can execute software, algorithms, and firmware in accordance with one or more example embodiments. Specifically, the processor 603 can execute software to calculate survey data, such as the inclination and azimuth from measurements received from the sensors. The processor 603 may also do additional quality control checks of the data from the sensor array 601, such as calculating total G and total magnetic field, further described below. In accordance with an embodiment, the processor 603 may analyze the survey data to see if it falls outside of a predetermined threshold, as disclosed further herein. The processor 603 can be an integrated circuit, a central processing unit, a multi-core processing chip, SoC, a multi-chip module including multiple multi-core processing chips, or other hardware processor in one or more example embodiments. The processor 603 may be defined by a computer processor, a microprocessor, a multi-core processor, or a combination thereof. Further, in some embodiments the processor 603 may be located on the non-rotating sub-assembly 105 or may be located on another part of the drill string. In some embodiments, the non-rotating sub-assembly 105 may not include a sub-assembly processor unit 602 and instead may be configured to send, transmit or otherwise communicate raw data from the sensor array 601 to the surface computing device 600.

In one or more example embodiments, the processor 603 can execute software instructions stored in memory/storage 604. Memory/storage 604 represents one or more computer storage media. Memory/storage 604 can include volatile media (such as random access memory (RAM)) and/or nonvolatile media (such as read only memory (ROM), flash memory, optical disks, magnetic disks, and so forth). Memory/storage 604 can include fixed media (e.g., RAM, ROM, a fixed hard drive, etc.) as well as removable media (e.g., a Flash memory drive, a removable hard drive, an optical disk, and so forth). The memory 604 can include one or more cache memories, main memory, and/or any other suitable type of memory. In certain configurations, the memory 604 can be integrated with the processor 603.

Measurements taken from the three accelerometers 301, 302, and 303, and the three directional sensors 304, 305, and 306 during a large vibrational event (with vibrational measurements outside of a predetermined threshold) can be discarded allowing for increased quality control of the data, and the monitoring of Total G and Total magnetic field can be used as a quality control measure. In certain embodiments, one or more additional accelerometers are included in the sensor assembly 100 to measure vibration. In some example embodiments, an additional quality control step is done downhole at the processor 603.

The transmitter 605 is any transmitter that can work down hole to transmit data to the surface. The transmitter 605 can include more than one transmitter that can be used, in series, to transmit data to the surface. The transmitter 605 and/or the power supply 606 may be located on the non-rotating sub-assembly 105 or may be located on a different part of the drill string. The transmitter 605 may be one or more of an acoustic transmitter, a wired transmitter, a wireless transmitter, a mud pressure transmitter, a coded transmitter using spread spectrum or similar schemes to transmit data in noisy environments, and an electromagnetic transmitter, for example. The transmitter 605 may also be a transducer.

The transmitter 605 can send survey data, directly or indirectly, to the receiver 610 within the surface computer device 600. The transmitter 605 can send data in a given format that follows a particular communication protocol, such as those that are used down hole. The survey data sent may include one or more of the following: raw data, such as sample, aggregated, or averaged measurements from the six sensors from the sensor array 610 and/or sample measurements from additional vibration sensors; rotation monitoring of the non-rotating section; SSI (Stick-Slip Indicator); an inclination; an azimuth; a time stamp, a temperature, a pressure, a lithology indicator such as gamma ray levels or others. Data may be transmitted to the receiver at least every 10 minutes, 5 minutes, 4 minutes, 3 minutes, 2 minutes, 1 minute, for example.

The surface computing device 600 of FIG. 6 is one example of a computing device and is not intended to suggest any limitation as to scope of use or functionality of the computing device and/or its possible architectures. Neither should computing device 600 be interpreted as having any dependency or requirement relating to any one or combination of components illustrated in the example computing device 600.

Surface computing device 600 can include one or more surface processors 607, one or more surface memory/storage components 608, one or more input devices 609, a receiver 610, a display 611, and a bus 612 that allows the various components and devices to communicate with one another. Bus 612 can represent one or more of any of several types of bus structures, including a memory bus or memory controller, a peripheral bus, an accelerated graphics port, and a processor or local bus using any of a variety of bus architectures. Bus 612 can include wired and/or wireless buses.

The surface processor 607 in the surface computing device 600 can be a hardware processor and executes software, algorithms, and firmware in accordance with one or more methods of the example embodiments. Specifically, the surface processor 607 can execute survey software, for example software to create, view, and/or edit a subsurface survey comprising a wellbore survey. The surface processor 607 can be an integrated circuit, a central processing unit, a multi-core processing chip, SoC, a multi-chip module including multiple multi-core processing chips, or other hardware processor in one or more example embodiments. The surface processor 607 may be defined as a computer processor, a microprocessor, a multi-core processor, or a combination thereof.

In one or more example embodiments, the surface processor 607 can execute software instructions stored in surface memory/storage 608. Surface Memory/storage component 608 represents one or more computer storage media. Surface memory/storage 608 can include volatile media (such as random access memory (RAM)) and/or nonvolatile media (such as read only memory (ROM), flash memory, optical disks, magnetic disks, and so forth). Surface memory/storage 608 can include fixed media (e.g., RAM, ROM, a fixed hard drive, etc.) as well as removable media (e.g., a Flash memory drive, a removable hard drive, an optical disk, and so forth). The surface memory/storage 608 can include one or more cache memories, main memory, and/or any other suitable type of memory. In certain configurations, the surface memory/storage 608 can be integrated with the processor 607.

One or more input devices 609 allow a user to enter commands and information to the surface computing device 600. Examples of input devices 609 include, but are not limited to, a keyboard, a cursor control device (e.g., a mouse), a microphone, a touchscreen, and a scanner. The display 611 allows information to be presented to a user. Examples of displays 611 include, but are not limited to, a monitor, a projector, a printer, a touchscreen, and a television.

The receiver 610 can receive survey data, directly or indirectly, from the transmitter 605. The receiver 610 can receive data in a given format that follows a particular communication protocol, such as those used to send data from down hole to the surface. The bus 612 can send the data packet received from the receiver 610 to the memory 608, the processor 607, and/or the display 611. The survey data sent may include one or more of the following: raw data, such as sample measurements from the six sensors from the sensor array 610 and/or from additional vibration sensors; an inclination; an azimuth; rotation monitoring of the non-rotating section; SSI (Stick-Slip Indicator); an inclination; an azimuth; a time stamp, a temperature, a pressure, a lithology indicator such as gamma ray levels or others. The bus 612 can send the data packet received from the receiver 610 to the memory 608 and/or the processor 607.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media."

"Computer storage media" and "computer readable medium" can include volatile and non-volatile, removable and non-removable media implemented in any method or technology for storage of information such as computer readable instructions, data structures, program modules, or other data. Computer storage media can include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The surface computing device 600 may be connected to a network (not shown) (e.g., a local area network (LAN), a wide area network (WAN) such as the Internet, cloud, or any other similar type of network) via a network interface connection (not shown) according to some exemplary embodiments. Those skilled in the art will appreciate that many different types of computer systems exist (e.g., desktop computer, a laptop computer, a personal media device, a server, a mobile device, such as a cell phone or personal digital assistant, or any other computing system capable of executing computer readable instructions), and the aforementioned input devices 609 and display 611 means take other forms, now known or later developed, in other exemplary embodiments. Generally speaking, the computer system 600 includes at least the minimal processing, input, and/or output means necessary to practice one or more embodiments.

Further, those skilled in the art will appreciate that one or more elements of the aforementioned surface computing device 600 may be located at a remote location and connected to the other elements over a network in certain exemplary embodiments. Further, one or more embodiments may be implemented on a distributed system having one or more nodes, where each portion of the implementation is located on a different node within the distributed system. In one or more embodiments, the node corresponds to a computer system. Alternatively, the node corresponds to a processor with associated physical memory in some exemplary embodiments. The node alternatively corresponds to a processor with shared memory and/or resources in some exemplary embodiments.

Further, as discussed above, such a surface computing system 600 can have corresponding software (e.g., user software, sensor software, controller software, network manager software), survey software, for example, software for creating, viewing, and/or editing a subsurface survey comprising one or more wellbore surveys. The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, Local Area Network (LAN), Wide Area Network (WAN), or other network communication methods) and/or communication channels, with wire and/or wireless segments according to some example embodiments.

Figure 8:
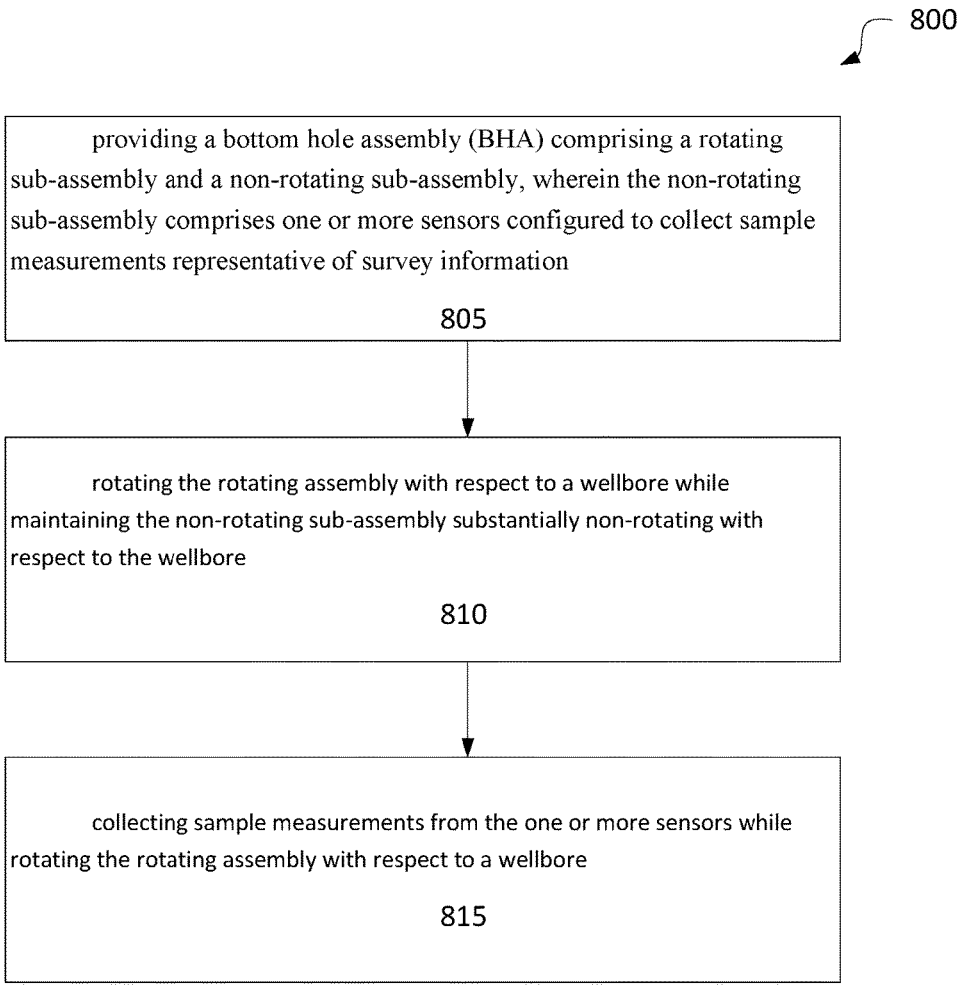
FIG. 8 is a flowchart of one example method of in accordance with an embodiment.

FIG. 8 is a flowchart showing a method for continuously surveying a wellbore while drilling in accordance with an embodiment. The embodied method 800 may be performed using the embodied systems disclosed herein. While the various steps in the flowchart presented herein are described sequentially, one of ordinary skill will appreciate that some or all of the steps may be executed in different orders, may be combined or omitted, and some or all of the steps may be executed in parallel. Further, in one or more of the example embodiments, one or more of the steps described below may be omitted, repeated, and/or performed in a different order. In addition, a person of ordinary skill in the art will appreciate that additional steps may be included in performing the methods described herein. Accordingly, the specific arrangement of steps shown should not be construed as limiting the scope. Further, in one or more example embodiments, a particular system comprising computing components, as described, for example, in FIG. 6 above, can be used to perform one or more of the method steps described herein.

In step 805, a bottom hole assembly (BHA) can be provided that comprising a rotating sub-assembly and a non-rotating sub-assembly. The non-rotating sub-assembly can include one or more sensors configured to collect sample measurements representative of survey information.

In step 810, the method can continue by rotating the rotating assembly with respect to a wellbore while maintaining the non-rotating sub-assembly substantially non-rotating with respect to the wellbore. "Substantially non-rotating," as used herein, refers to a rotation of less than 4 RPM.

In step 815, the method can continue by collecting sample measurements from the one or more sensors while rotating the rotating assembly with respect to a wellbore.

It will be appreciated that various other features of the method described with respect to FIG. 8 can be the same or can include features described below with respect to the method represented in FIG. 7.

FIG. 7 is a flowchart showing a method for continuously surveying a wellbore while drilling in accordance with an embodiment. The embodied method 700 may be performed using the embodied systems disclosed herein. While the various steps in the flowchart presented herein are described sequentially, one of ordinary skill will appreciate that some or all of the steps may be executed in different orders, may be combined or omitted, and some or all of the steps may be executed in parallel. Further, in one or more of the example embodiments, one or more of the steps described below may be omitted, repeated, and/or performed in a different order. In addition, a person of ordinary skill in the art will appreciate that additional steps may be included in performing the methods described herein. Accordingly, the specific arrangement of steps shown should not be construed as limiting the scope. Further, in one or more example embodiments, a particular system comprising computing components, as described, for example, in FIG. 6 above, can be used to perform one or more of the method steps described herein.

In step 705, a borehole can be drilled with a drill string while a non-rotating sub-assembly 105, which is permanently attached to the drill string and at a constant distance from the drill, can be held substantially non-rotating. "Substantially non-rotating," as used herein, refers to a rotation of less than 4 RPM.

In step 710, accelerometers and directional sensors located on the non-rotating sub-assembly 105 can collect sample measurements continuously while the drill string is rotating. "Continuous" or "continuously," as used herein, refers to data (e.g., survey data, sample measurements, or a combination thereof) collected, stored in memory, or transmitted at intervals of less than 5 minutes, less than 4 minutes, less than 3 minutes, less than 2 minutes, less than 1 minute, less than 45 seconds, less than 30 seconds, less than 20 seconds, less than 10 seconds, less than 5 seconds, or less than 1 second. "Continuous" or "continuously," as used herein, can also refer to data (e.g., survey data, sample measurements, or a combination thereof) collected, stored in memory, or transmitted at intervals reflective of the smallest interval the accelerometer or directional sensor can physically or operationally sample. It will be appreciated that "continuous" or "continuously" can refer the continuous collection, storage, transmission of data over a certain period of time. In an embodiment, the period of time defining continuous our continuously collecting, storing or transmitting data can be at least 1 second, at least 5 seconds, at least 10 second, at least 20 seconds, at least 30 seconds, at least 45 seconds, at least 1 minute, at least 2 minutes, at least 3 minutes, at least 4 minutes, at least 5 minutes, at least 10 minutes, or at least 20 minutes. In accordance with some embodiments, the sensors can be sampled sufficiently simultaneously to provide concurrent measure of the environment. Additional vibrational sensors and/or temperature sensors can also be sampled in this step. Calibration, correction, aggregation, and/or averaging may be done to the sample measurement data during this step. For example, the sample measurements may be corrected for orthogonally, temperature. The "sample measurements" used in subsequent steps of the method may then done on the mathematically manipulated sample measurements, and not on the raw measurements received directly from the sensors.

In step 715, a hardware processor can calculate the inclination of the wellbore from the accelerometer sample measurements (raw, aggregated, averaged, calibrated, and/or corrected). The hardware processor may be located sub-surface, such as on the non-rotating sub-assembly 105 or on the drill string, or the hardware processor may be located at the surface, such as at or near the drilling platform 402 or at a remote location. For example, the hardware processor could be the processor 603 or surface processor 607. In embodiments of the disclosure, the inclination is calculated using the following formula: Inclination=tan^(−1) [√($G_x^2$+$G_y^2$)/$G_z$], wherein Gz is the sample measurement from the accelerometer with an axis aligned with the direction of the drill and Gy and Gx are the sample measurements from the accelerometers orthogonal to each other and across the directional axis of the drill. In some embodiments, if the non-rotating sub-assembly rotates at high than normal speeds, for example, higher than 4 rpm, or when a large vibrational event occurs, the inclination may be calculated based on z-axis and total field only (either a predetermined total field, or a total field measured and averaged on better measurements obtained while drilling). This calculation averages the accelerometer measurements over time to cancel out vibration. In an embodiment when high axial shock causes saturation of the z axis accelerometer, the inclination may be calculated based on x, y and total field.

In step 720, a hardware processor calculates the azimuth of a wellbore from the inclination calculated in step 715 and the sample measurements (raw, aggregated, averaged, calibrated, and/or corrected) taken from the directional sensor. The hardware processor may be located sub-surface, such as on the non-rotating sub-assembly 105 or on the drill string, or the hardware processor may be located at the surface 403, such as at or near the drilling platform 402 or at a remote location. For example, the hardware processor could be processor 603 or surface processor 607. However, if the inclination calculated in step 715 was calculated at the surface processor, the azimuth is also calculated at the surface processor. In embodiments of the disclosure, the azimuth is calculated using the following formula: azimuth=$\tan^{-1}$ [($G_t$($B_yG_x$−$B_xG_y$))/($B_z$(G^^2+$G_y$^^2)−$G_z$($G_xB_x$+$G_yB_y$))], wherein $G_x$, $G_y$, and $G_z$ are as described above, $G_t$ is SQRT($Gx^2$+$Gy^2$+$Gz^2$) and $B_Z$ is the sample measurement from the directional sensor with an axis aligned with the direction of the drill and $B_y$ and $B_x$ are the sample measurements from the directional sensors orthogonal to each other and across the directional axis of the drill.

In step 725, a hardware processor calculates the wellbore position from a previously determined wellbore position, the azimuth calculated in step 720, the inclination calculated in step 715, and the measured depth. The calculated azimuth may be re-referenced to a different North such as true north or grid north. The hardware processor may be located at the surface, such as at or near the drilling platform or at a remote location. For example, the hardware processor could be the processor 603 or surface processor 607. However, if the azimuth calculated in step 725 was calculated at the surface processor, the wellbore position is also calculated at the surface processor. In embodiments of the disclosure, the wellbore position is calculated using the following formulas:

Minimum Curvature $$\text{Ratio Factor } (RF) = \left(\frac{2}{DL}\right)\tan\left(\frac{DL}{2}\right)$$

$$\text{Note; if } DL = 0,\ RF = 1$$

$$\Delta N = \left(\frac{\Delta MD}{2}\right)[\sin(I_1)\cos(A_1) + \sin(I_2)\cos(A_2)] * RF$$

$$\Delta E = \left(\frac{\Delta MD}{2}\right)[\sin(I_1)\sin(A_1) + \sin(I_2)\sin(A_2)] * RF$$

$$\Delta TVD = \left(\frac{\Delta MD}{2}\right)[\cos(I_1) + \cos(I_2)] * RF$$

In step 730, survey data can be displayed. In some embodiments, the survey data displayed can include one or more of the raw sample measurements, the inclination, the azimuth, the wellbore position, or a combination thereof. In some embodiments, the survey data could be displayed as part of a three dimensional survey of a subterranean formation. In some embodiments, only the current wellbore survey is displayed. In other embodiments, a formation survey could include the wellbore surveys of other active drilling operations and/or wellbores that have been previously drilled.

Once the survey data is displayed, additional commands may be input into the input device 609. Additional commands may include changing the direction of the actively operating drill or changing the planned path of the wellbore that has yet to be drilled. In some embodiments, upon calculation of the wellbore position a projection may be made to the bottom of the wellbore to determine its likely position and from this, in collaboration with the wellbore's attitude measurement, the downhole RSS 107 may be commanded to alter its settings in order to attain the desired well trajectory In some embodiments of the disclosure, the six sensors in the sensor array 601 can be calibrated prior to or just after an initial wellbore is drilled. This calibration can adjust for general sensor position, such as sensors that have been mounted off orthogonal, for example. The sensors can further be calibrated down hole to account for environmental changes that may affect sensor readings, such as magnetic interference and temperature. In embodiments, the further down hole calibration includes multi-station analysis. In embodiments of the disclosure, multi-station analysis calibration is completed one or more times while the drill string is down hole. In some embodiments, the multi-station analysis calibration is done on the processor 603. In other embodiments, the multi-station analysis calibration is done by surface processor 607, the calibration data from the multi-station analysis calibration is transferred to the non-rotating sub-assembly 105 and used to calibrate sensor array 601.

In embodiments, prior to calculating the inclination and azimuth, two or more sample measurements from the same sensor can be averaged to provide a single value for the purpose of wellbore attitude determination. In certain embodiments, the sample measurements can be quality control checked against a predetermined threshold and only sample measurements that fall within the threshold are used for succeeding steps. For example, large vibrations may throw off the accuracy of the sample measures and, as such, samples which fall outside of a vibrational frequency could be removed from the calculations, increasing accuracy.

In embodiments, total gravity and total magnetic field may be calculated. The total field is an additional quality indicator and may also be used in quality control to discard sample measurements that reside outside of a predetermined threshold. The total gravity and magnetic fields may be calculated as the square root of $(x^2+y^2+z^2)$. Changes in the total magnetic field can be used to warn a user when there is magnetic interference and therefore, reduced azimuth accuracy. In some embodiments, errors in the total field can also be used to detect and warn users of sensor failure and/or deterioration.

Example embodiments can generate a full three dimensional survey of a wellbore based on actual, accurate, real-time data, while the drill is drilling. Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

Embodiments

Embodiment 1. A method of continuously surveying a wellbore, comprises: providing a bottom hole assembly comprising a non-rotating sub-assembly, wherein the non-rotating sub-assembly is held substantially non-rotating with relation to the wellbore and at a constant distance from a drill of the drill string, and wherein the non-rotating sub-assembly comprises: a first, second, and third accelerometer; a first, second, and third directional sensor; drilling a borehole with the drill string, wherein sample measurements are collected from the first, second, and third accelerometers and the first, second, and third directional sensors while the drill string is drilling; calculating, using a hardware processor, an inclination from the sample measurements collected from the first, second, and third accelerometers; calculating, using a hardware processor, an azimuth from the inclination and the sample measurements collected from the first, second, and third directional sensors; calculating, using a hardware processor, a wellbore position from an initial wellbore position, the inclination, the azimuth, and current depth of the bottom hole assembly; transmitting survey data to a surface computing device from the non-rotating sub-assembly, wherein survey data comprises one or more of the sample measurements, the inclination, and the azimuth; calculating, at the surface computing device, a survey using the survey data; and displaying the survey on a display coupled to the surface computing device.

Embodiment 2. The method of embodiment 1, wherein the data transmitted to the surface computing device comprises the sample measurements, and wherein calculating the inclination, azimuth, and wellbore position is done at the surface computing device after the survey data is transmitted to the surface computing device.

Embodiment 3. The method of embodiment 1, wherein the bottom hole assembly comprises the hardware processor used to calculate the inclination.

Embodiment 4. The method of embodiment 4, wherein the bottom hole assembly hardware processor is also used to calculate the azimuth.

Embodiment 5. The method of embodiment 1, wherein the sample measurements are collected continuously.

Embodiment 6. The method of embodiment 1, wherein the sample measurements are collected at least every 0.5 seconds, 1 second, 5 seconds, every 10 seconds, every 20 seconds, every 30 seconds, every 40 seconds, every 50 seconds, every minute, every 2 minutes, 10 minutes.

Embodiment 7. The method of embodiment 1, wherein the survey data is transmitted at least every minute, every two minutes, every three minutes, every four minutes, every five minutes, every ten minutes, every twenty minutes, or every thirty minutes.

Embodiment 8. The method of embodiment 1, wherein the majority of the bottom hole assembly is non-magnetic.

Embodiment 9. The method of embodiment 1, wherein the non-rotating sub-assembly is held substantially non-rotating with relation to the wellbore due to friction of the sub-assembly against the well-bore.

Embodiment 10. The method of embodiment 1, wherein the non-rotating sub-assembly is held substantially non-rotating with relation to the wellbore due to counter rotation of the sub-assembly.

Embodiment 11. The method of embodiment 1, wherein the sample measurements collected from the first, second, and third accelerometers and the first, second, and third directional sensors are taken simultaneously.

Embodiment 12. The method of embodiment 1, wherein the first, second, and third directional sensors are magnetometers.

Embodiment 13. The method of embodiment 12, wherein the non-rotating sub-assembly additionally comprises one or more of a fourth, fifth, and sixth magnetometer in a same axis as one or more of the first, second, or third magnetometers.

Embodiment 14. The method of embodiment 1, comprising calibrating the first, second, and third accelerometers and first, second, and third directional sensors prior to entering the wellbore.

Embodiment 14. The method of embodiment 14, comprising further calibrating the first, second, and third accelerometer and first, second, and third directional sensor to account for the wellbore environment while in the wellbore.

Embodiment 15. The method of embodiment 14, wherein the further calibration is done by multi-station analysis to recalibrate the sensor's bias and scale factor to compensate for the changes in the sensor's down hole environment from its surface calibration and thereby provide reference quality survey data as the well is being drilled.

Embodiment 16. The method of embodiment 1, additionally comprising only calculating the inclination and azimuth for sample measurements that have a vibration within a predetermined threshold.

Embodiment 17. The method of embodiment 1, additionally comprising only calculating the inclination and azimuth for sample measurements that have a sample measurement within a predetermined threshold.

Embodiment 18. The method of embodiment 1, wherein the first, second, and third accelerometer are arranged in substantially orthogonal positions to each other and the first, second, and third directional sensors are arranged substantially orthogonally to each other.

Embodiment 19. The method of embodiment 18, wherein a sensor axis of the first accelerometer is directionally aligned with the wellbore, and sensor axes of the second and third accelerometers are arranged orthogonally across an axis of the wellbore and a sensor axis of the first directional sensor is directionally aligned with the wellbore, and sensor axes of the second and third directional sensors are arranged orthogonally across the wellbore axis.

Embodiment 20. The method of embodiment 1, wherein the non-rotating sub-assembly further comprises vibration sensors.

Embodiment 21. The method of embodiment 1, further comprising correcting sample measurements collected from the first, second, and third accelerometers for sensor orthogonality, temperature, and calibration prior to calculating the inclination.

Embodiment 22. The method of embodiment 21, wherein correcting for calibration includes adjusting the scale and bias of the sample measurements.

Embodiment 23. The method of embodiment 1, further comprising correcting sample measurements collected from the first, second, and third directional sensors for sensor orthogonally, temperature, and calibration prior to calculating the azimuth.

Embodiment 24. The method of embodiment 23, wherein correcting the calibration includes adjusting the scale, bias and non-linearity of the sample measurements.

Embodiment 25. The method of embodiment 1, wherein the bottom hole assembly further comprises a temperature sensor.

Embodiment 26. The method of embodiment 1, wherein the sample measurements are corrected for temperature.

Embodiment 26. The method of embodiment 1, wherein the inclination is calculated using averaged sample measurements collected from the first, second, and third accelerometers.

Embodiment 27. The method of embodiment 1, wherein the azimuth is calculated using averaged sample measurements collected from the first, second, and third directional sensors.

Embodiment 28. A method of continuously surveying a wellbore, comprising: providing a bottom hole assembly (BHA) comprising a rotating sub-assembly and a non-rotating sub-assembly, wherein the non-rotating sub-assembly comprises one or more sensors configured to collect sample measurements representative of survey information; rotating the rotating assembly with respect to a wellbore while maintaining the non-rotating sub-assembly substantially non-rotating with respect to the wellbore; and collecting sample measurements from the one or more sensors while rotating the rotating assembly with respect to a wellbore.

Embodiment 29. The method of embodiment 28, wherein the one or more sensors comprises: a first, second, and third accelerometer; and a first, second, and third directional sensor.

Embodiment 30. The method of embodiment 28, further comprising calculating, using a hardware processor, an inclination from the sample measurements collected from the one or more sensors.

Embodiment 31. The method of embodiment 28, further comprising calculating, using a hardware processor, an azimuth from the inclination and the sample measurements collected from the one or more sensors.

Embodiment 32. The method of embodiment 28, further comprising calculating, using a hardware processor, a wellbore position from an initial wellbore position, an inclination, an azimuth, and a current depth of the bottom hole assembly (BHA).

Embodiment 33. The method of embodiment 28, further comprising transmitting the sample measurements to a surface computing device from the non-rotating sub-assembly, wherein the sample measurements comprises one or more of an inclination and an azimuth of the bottom hole assembly (BHA).

Embodiment 34. The method of embodiment 33, further comprising calculating, at the surface computing device, a survey using the survey data, and displaying the survey on a display coupled to the surface computing device.

What is claimed is:

1. A method of continuously surveying a wellbore, comprising:

providing a bottom hole assembly (BHA) comprising a rotating sub-assembly and a non-rotating sub-assembly, wherein the non-rotating sub-assembly comprises one or more sensors configured to collect sample measurements representative of survey information;

rotating the rotating sub-assembly with respect to a wellbore while maintaining the non-rotating sub-assembly substantially non-rotating with respect to the wellbore;

collecting sample measurements from the one or more sensors while rotating the rotating sub-assembly with respect to a wellbore; and calculating, using a hardware processor, a wellbore position from an initial wellbore position, an inclination, an azimuth, and a current depth of the bottom hole assembly (BHA).

2. The method of claim 1, wherein the one or more sensors comprises:

a first, second, and third accelerometer; and a first, second, and third directional sensor.

3. The method of claim 1, further comprising calculating, using a hardware processor, an inclination from the sample measurements collected from the one or more sensors.

4. The method of claim 1, further comprising calculating, using a hardware processor, an azimuth from the inclination and the sample measurements collected from the one or more sensors.

5. The method of claim 1, further comprising transmitting the sample measurements to a surface computing device from the non-rotating sub-assembly, wherein the sample measurements comprise one or more of an inclination and an azimuth of the bottom hole assembly (BHA).

6. The method of claim 5, further comprising calculating, at the surface computing device, a survey using the sample measurements, and displaying the survey on a display coupled to the surface computing device.

7. A method of continuously surveying a wellbore, comprising:

providing a bottom hole assembly comprising a non-rotating sub-assembly, wherein the non-rotating sub-assembly is held substantially non-rotating with relation to the wellbore and at a constant distance from a drill of a drill string, and wherein the non-rotating sub-assembly comprises:

a first, second, and third accelerometer; and a first, second, and third directional sensor;

drilling a borehole with the drill string, wherein sample measurements are collected from the first, second, and third accelerometers and the first, second, and third directional sensors while the drill string is drilling;

calculating, using a hardware processor, an inclination from the sample measurements collected from the first, second, and third accelerometers;

calculating, using a hardware processor, an azimuth from the inclination and the sample measurements collected from the first, second, and third directional sensors;

calculating, using a hardware processor, a wellbore position from an initial wellbore position, the inclination, the azimuth, and current depth of the bottom hole assembly;

transmitting survey data to a surface computing device from the non-rotating sub-assembly, wherein the survey data comprises one or more of the sample measurements, the inclination, and the azimuth;

calculating, at the surface computing device, a survey using the survey data; and displaying the survey on a display coupled to the surface computing device.

8. The method of claim 7, wherein the survey data transmitted to the surface computing device comprises the sample measurements, and wherein calculating the inclination, azimuth, and wellbore position is done at the surface computing device after the survey data is transmitted to the surface computing device.

9. The method of claim 7, wherein the bottom hole assembly comprises the hardware processor used to calculate the inclination and or azimuth.

10. The method of claim 7, wherein the sample measurements are collected continuously.

11. The method of claim 7, wherein the survey data is transmitted continuously.

12. The method of claim 7, wherein the sample measurements collected from the first, second, and third accelerometers and the first, second, and third directional sensors are taken simultaneously.

13. The method of claim 7, further comprising detecting vibration, determining whether the vibration is within a predetermined threshold, and calculating the inclination and azimuth for sample measurements if the vibration is within a predetermined threshold.

14. The method of claim 7, wherein the first, second, and third accelerometer are arranged in substantially orthogonal positions to each other and the first, second, and third directional sensors are arranged substantially orthogonally to each other.

15. The method of claim 7, wherein a sensor axis of the first accelerometer is directionally aligned with the wellbore, and sensor axes of the second and third accelerometers are arranged orthogonally across an axis of the wellbore and a sensor axis of the first directional sensor is directionally aligned with the wellbore, and sensor axes of the second and third directional sensors are arranged orthogonally across the wellbore axis.

16. The method of claim 7, further comprising correcting sample measurements collected from the first, second, and third directional sensors for sensor orthogonally, temperature, and calibration prior to calculating the azimuth.

17. The method of claim 8, wherein the sample measurements are corrected for temperature.

18. The method of claim 7, wherein the inclination is calculated using averaged sample measurements collected from the first, second, and third accelerometers.

19. The method of claim 7, wherein the azimuth is calculated using averaged sample measurements collected from the first, second, and third directional sensors.

* * * * *